US008434254B1

(12) United States Patent
Watchorn et al.

(10) Patent No.: US 8,434,254 B1
(45) Date of Patent: May 7, 2013

(54) SAFETY MAGAZINES FOR FIRING NON-LETHAL TRAINING ROUNDS AND PREVENTING THE LOADING AND FIRING OF LIVE ROUNDS

(75) Inventors: Doug Watchorn, Frenchtown, NJ (US); Barry Littlewood, Phillipsburg, NJ (US)

(73) Assignee: Bihler of America, Inc., Phillipsburg, NJ (US)

( * ) Notice: Subject to any disclaimer, the term of this patent is extended or adjusted under 35 U.S.C. 154(b) by 24 days.

(21) Appl. No.: 13/278,474

(22) Filed: Oct. 21, 2011

(51) Int. Cl.
*F41A 9/61* (2006.01)

(52) U.S. Cl.
USPC ..... 42/50

(58) Field of Classification Search ..... 42/50, 49.1, 42/6, 49.01, 49.02; 89/33.1
See application file for complete search history.

(56) References Cited

U.S. PATENT DOCUMENTS 3,465,463 A * 9/1969 Grandy et al. ..... 42/50
4,079,535 A 3/1978 Elbe et al.
4,619,062 A 10/1986 Johnson
4,654,992 A 4/1987 Lavergne
4,777,752 A * 10/1988 Howard ..... 42/50
5,782,029 A 7/1998 Brooks
6,412,207 B1 7/2002 Crye et al.
6,715,396 B2 4/2004 Dionne
2004/0211103 A1 10/2004 Aske
2005/0235547 A1 10/2005 Ducastel

* cited by examiner

*Primary Examiner* — Stephen M Johnson
*Assistant Examiner* — John D Cooper
(74) *Attorney, Agent, or Firm* — Doherty & Charney LLC

(57) ABSTRACT

A safety magazine allows training rounds to be fired while preventing the firing of live rounds. The magazine has front and rear walls, whereby the distance between the front wall and the rear wall is less than the length of a standard 5.56×45 mm NATO cartridge. The magazine has an alignment rib projecting from the rear wall that is adapted for insertion into an alignment groove formed in a rear end wall of a standard M16 style magazine well. The magazine has a spacer projecting laterally from the sides of said alignment rib and that is located between the rear wall of the magazine and the rear face of the alignment rib. The spacer is adapted to engage the rear end wall of the standard M16 style magazine well for spacing the rear wall of the safety magazine away from the rear end wall of the magazine well.

20 Claims, 10 Drawing Sheets

SAFETY MAGAZINES FOR FIRING NON-LETHAL TRAINING ROUNDS AND PREVENTING THE LOADING AND FIRING OF LIVE ROUNDS

BACKGROUND OF THE INVENTION

1. Field of the Invention

The present invention is generally related to firearms and is more particularly related to ammunition magazines used with firearms.

2. Description of the Related Art

During training exercises, military personnel frequently use blank rounds to replicate a combat situation. Blank rounds are also used by police officers to control crowds during riots and civil disturbances, and by the entertainment industry in movies and stage productions.

In recent years, the military has begun to use non-lethal training rounds for force-on-force training. Each non-lethal training round has a non-lethal projectile that is fired at low velocity. The non-lethal projectiles may include paint or ink that leaves a visible mark on the struck object (e.g., an opposition force soldier who has been shot).

Standard magazines have been used to hold live rounds, blank rounds, and non-lethal training rounds. Unfortunately, using the same standard magazine for holding both live rounds and blank/training rounds can be hazardous if a live round is intermixed with blank/training rounds in the same magazine. Regardless of whether the live rounds are placed in the standard magazine on purpose or by accident, the live rounds may not be visible through the opaque walls of the magazine. For example, a soldier may only see blank rounds on top of the magazine and may not be aware that the standard magazine contains one or more live rounds. The magazine may then be inserted into the magazine well of a firearm, and the live round(s) will be fired in the midst of the blank/training rounds, which may result in injury or death to those in the line of fire There have been some attempts directed to avoiding the intermixing of live rounds with blank/training rounds. For example, U.S. Pat. No. 4,777,752 to Howard discloses a blank magazine having a structure that is different than the structure of a standard magazine for overcoming the safety disadvantages inherent in the use of standard magazines for force-on-force training exercises. In Howard, the blank magazine has a back wall with an inner surface, and a front wall with an inner surface and a top. The blank magazine structure in Howard prevents a live round from being fed by a bolt of a firearm into the chamber of the firearm. If a live round is inserted into the magazine, the top of the front wall engages the projectile of the live round and a cartridge-retaining lip holds the base of a live round lower than it does for the base of a blank, thereby altering the angle of the live round in the magazine. A shorter blank round is not re-positioned at an angle relative to the axis of movement of the bolt. The different position of the blank round compared to the live round permits the bolt to feed the blank round but prevents the bolt from feeding the live round into the chamber of the firearm.

Although Howard teaches that the bolt will not feed the live round into the chamber, the structure of the Howard magazine still allows a magazine having both live and training rounds loaded therein to be fully inserted into the magazine well of a firearm. This dramatically increases the chances that the live round will be accidently directed into the chamber by the bolt.

Thus, in spite of the above advances, there remains a need for a safety magazine that prevents a magazine containing a live round from being fully inserted into a magazine well of a firearm. There also remains a need for a safety magazine that prevents the loading of live 5.56 mm rounds into an M16 style magazine well of a M16 or M4 rifle.

SUMMARY OF THE INVENTION

M16 is the official designation used by the United States military for the AR-15 rifle. In 1963, the M16 was first used by the United States Army for jungle warfare operations in South Vietnam, and in 1969, it became the U.S. military's standard service rifle for the Vietnam War. The M16 is now the primary service rifle of the U.S. military, and it has been widely adopted by militaries around the world. Since the design's introduction, about eight million M16-style weapons have been produced, making it the most popular firearm of its caliber.

The M16 is now being phased out in the United States Army. It is being replaced by the M4 carbine, which is a gas-operated, air-cooled, magazine-fed, selective fire, shoulder-fired weapon with a telescoping stock. The M4 has a shorter barrel than the M16, allowing the individual soldier to better operate in close quarters. The M4 has selective fire options including semi-automatic and three-round burst. The M4 is slated to eventually replace the M16 rifle in most combat units in the United States Army.

Both the M16 and M4 rifles are built using exacting military specifications set forth under NATO Standardization Agreements (STANAG) and United States Government Issue (U.S.G.I.) standards. Each NATO state ratifies a STANAG and implements it within its own military. STANAGs provide common operational and administrative procedures and logistics so the military of one member nation may use the stores and support of another member nation's military.

Various NATO STANAGs have been used to ensure the interoperability of ammunition and weapons between the different member states of NATO. Specifically, STANAG 4172 adopts the 5.56×45 mm NATO cartridge as the standard cartridge for all NATO assault rifles. Both the M16 rifle and the M4 carbine use a 5.56×45 mm cartridge, which is officially designated the 5.56×45 mm NATO cartridge.

NATO and the U.S. military have developed exacting specifications regarding the structure and dimensions of magazines for 5.56×45 mm NATO cartridges that are used with the M16 rifle and the M4 carbine. STANAG 4179 adopts the M16 style magazine well as the standard 5.56×45 NATO magazine interface. All magazines and drums, regardless of design, must be compatible with the standard M16 style magazine well in order to be compliant. Both the M16 and M4 are built in compliance with STANAGs 4172 and 4179.

The present application uses the terminology standard magazine and safety magazine. As used herein, the term standard magazine means a magazine that complies with STANAGs 4172 and 4179, and U.S.G.I. standards, that is loaded with live, lethal cartridges, and that may be inserted into a M16 style magazine well for use with a NATO assault rifle. As used herein, the terms "live round" or "5.56×45 mm NATO cartridge" means a lethal round having a propellant and a projectile that complies with STANAG 4172, and that is loaded into a standard magazine.

As used herein, the term "safety magazine" means a magazine that may also be inserted into a NATO compatible M16 style magazine well for use with a standard NATO assault rifle, but that may only receive non-lethal training rounds. The exact outer dimensions or outer configuration of the safety magazine disclosed herein may differ from the standard magazine dimensions set forth in STANAG 4179, however, it is contemplated that the safety magazine may still be fully inserted and properly secured into a M16 style magazine well, which meets the standards set forth under STANAG 4179.

One embodiment of the present invention discloses a safety magazine that is insertable into a standard M16 style magazine well. The safety magazine is preferably adapted for enabling non-lethal training cartridges to be fired using a firearm, such as a M16 or M4 rifle, while preventing the loading and firing of a live cartridge, such as a standard 5.56×45 mm NATO cartridge.

In one embodiment, the safety magazine preferably includes a front wall having an outer surface and an inner surface, and an opposing rear wall having an outer surface and an inner surface. In one embodiment, the distance between the front and rear walls is less than the length of a standard 5.56×45 mm NATO cartridge, which is about 2.260 inches in length. The safety magazine desirably includes first and second sidewalls that extend between the front and rear walls. The front wall, rear wall, and first and second sidewalls have upper ends that surround a magazine opening through which cartridges may be loaded into the magazine.

In one embodiment, the safety magazine preferably includes an alignment rib projecting from the rear wall of the magazine. The alignment rib is desirably longer than an alignment rib on a standard M16 magazine. The alignment rib preferably has a rear face that is parallel to the rear wall of the safety magazine.

In one embodiment, the safety magazine desirably has a spacer projecting laterally from the sides of the alignment rib. The spacer is preferably located between the rear wall of the safety magazine and the rear face of the alignment rib. The spacer desirably has a proximal surface that is parallel to both the rear wall of the safety magazine and the rear face of the alignment rib. In one embodiment, the alignment rib is adapted for insertion into an alignment groove formed in a rear end wall of a standard M16 style magazine well, and the proximal surface of the spacer is adapted to engage the rear end wall of the standard M16 style magazine well for spacing the rear wall of the safety magazine away from the rear end wall of the standard M16 style magazine well.

In one embodiment, the distance between the rear face of the alignment rib of the safety magazine and an inner surface of the rear wall of the safety magazine is at least 50% greater than a comparable distance measured between a rear face of an alignment rib and an inner surface of a rear wall on a standard M16 magazine that complies with NATO Standardization Agreement 4179. In one embodiment, the distance between the rear face of the alignment rib and the inner surface of the rear wall of the safety magazine is at least 60% greater than the comparable distance on the standard M16 magazine, and more preferably about 70% greater than the comparable distance on the standard M16 magazine. In one embodiment, the distance between the rear face of the alignment rib of the safety magazine and an inner surface of the rear wall of the safety magazine is about 0.321 inches and the comparable distance on the standard M16 magazine is about 0.188 inches.

In one embodiment, the distance between the proximal face of the spacer and the inner surface of the rear wall of the safety magazine is about 0.171 inches. The distance between opposing inner surfaces of the front and rear walls is preferably about 2.148 inches and the length of the non-lethal training round is desirably about 2.079 inches.

In one embodiment, the distance between the rear face of the alignment rib and an inner surface of the rear wall of the safety magazine is about 0.321 inches and the distance between the rear face of the alignment rib and the proximal face of the spacer is about 0.150 inches.

In one embodiment, the safety magazine is preferably adapted for being inserted into a standard M16 style magazine well that complies with dimension specifications set forth under NATO Standardization Agreement 4179. A standard M16 style magazine well has a length of about 2.545 inches, and the length of the safety magazine measured between the outer surface of the front wall and the rear face of the alignment rib is preferably less than 2.545 inches. In one embodiment, the safety magazine has a length of about 2.543 inches.

In one embodiment, a safety magazine for a standard M16 style magazine well that enables non-lethal training rounds to be fired while preventing the loading and firing of 5.56 mm live rounds preferably includes a front wall and a rear wall spaced from the front wall, whereby the distance between opposing inner surfaces of the front and rear walls is less than the length of a standard 5.56 mm live round. The safety magazine desirably includes an elongated alignment rib projecting rearwardly from the rear wall of the safety magazine, the elongated alignment rib having a rear face that is parallel to the inner surface of the rear wall of the safety magazine, whereby the distance between the rear face of the alignment rib and the inner surface of the rear wall of the safety magazine is about 0.321 inches. The safety magazine may include a spacer projecting laterally from opposite sides of the alignment rib and being located between the rear wall of the safety magazine and the rear face of the elongated alignment rib, the spacer having a proximal surface that is parallel to the inner surface of the rear wall of the safety magazine and the rear face of the alignment rib. In one embodiment, the distance between the proximal surface of the spacer and the rear face of the elongated alignment rib is about 0.150 inches.

In one embodiment, the spacer includes a spacer wall adapted for spacing the rear wall of the safety magazine away from a rear end wall of a standard M16 style magazine well when the safety magazine is inserted into the standard M16 style magazine well. In one embodiment, the distance between the inner surface of the front wall and the inner surface of the rear wall of the safety magazine is preferably about 2.148 inches and a non-lethal training round adapted for being loaded into the safety magazine has a length of less than 2.148 inches, and more preferably about 2.079 inches.

In one embodiment, the safety magazine is preferably adapted for being inserted into a standard M16 style magazine well that complies with the magazine well dimension requirements set forth under NATO Standardization Agreement 4179 and under United States Government Issue standards. The standard M16 style magazine well has a length of about 2.545 inches, and the length of the safety magazine measured from the outer surface of the front wall to the rear face of the elongated alignment rib is desirably less than 2.545 inches, and more preferably about 2.543 inches.

In one embodiment, a safety magazine is adapted for insertion into a standard M16 style magazine well provided on a fireman having a lower receiver that complies with NATO Standardization Agreement 4179. The safety magazine desirably enables non-lethal training rounds to be fired with the firearm while preventing the loading and firing of 5.56×45 mm NATO cartridges. The safety magazine desirably includes a front wall and a rear wall, whereby the distance between opposing inner surfaces of the front and rear walls is less than the length of a 5.56×45 mm NATO cartridge. The safety magazine desirably includes an elongated alignment rib projecting rearwardly from the rear wall, the elongated alignment rib having a rear face that is parallel to the inner surface of the rear wall of the safety magazine, whereby the distance between the rear face of the elongated alignment rib and the inner surface of the rear wall of the safety magazine is about 0.321 inches, and a spacer projecting laterally from the sides of the alignment rib and being located between the rear face of the elongated alignment rib and the inner surface of the rear wall of the safety magazine, the spacer having a proximal surface that is parallel to the inner surface of the rear wall and the rear face of the elongated alignment rib, whereby the distance between the proximal surface of the spacer and the rear face of the elongated alignment rib is about 0.150 inches.

In one embodiment, the length of one of the 5.56×45 mm NATO cartridges is preferably greater that the distance between the inner surface of the rear wall of the safety magazine and the outer surface of the front wall of the safety magazine. In one embodiment, the length of one of the 5.56×45 mm NATO cartridges is about 2.260 inches, and the distance between the inner surface of the rear wall and the outer surface of the front wall is about 2.233 inches. When one of the 5.56×45 mm NATO cartridges is loaded into the safety magazine, the leading tip of the 5.56×45 mm NATO cartridges desirably extends beyond the outer surface of the front wall of the safety magazine, which prevents the safety cartridge from being inserted into the magazine well. In particular, the tip of the 5.56×45 mm NATO cartridge will strike a ledge at an upper end of the magazine well, which prevents further insertion of the 5.56 mm cartridge and the magazine holding the cartridge.

In one embodiment, the opening at the upper end of the safety magazine used for loading rounds into the safety magazine is shorter than the magazine opening on a standard magazine. The shorter magazine opening will accept the shorter, training rounds, but will not enable the longer, liver rounds to be properly loaded into the safety magazine. If an operator does accidently load a live round as the top round in the safety magazine, the shorter length of the magazine opening for the safety round ensures that at least the tip of the projectile will extend beyond the front wall of the safety magazine. When an operator attempts to insert the safety magazine with the live round on top into the magazine well, the tip of the live round will strike a ledge at the leading end of the magazine well that will prevent further advancement of the live round and the magazine into the magazine well. Thus, the presence of the live round at the top of the magazine will absolutely prevent full insertion of the safety magazine into the magazine well, which means that the live round can never be properly chambered in the firearm.

These and other preferred embodiments of the present invention will be described in more detail below.

DETAILED DESCRIPTION

Figure 1:
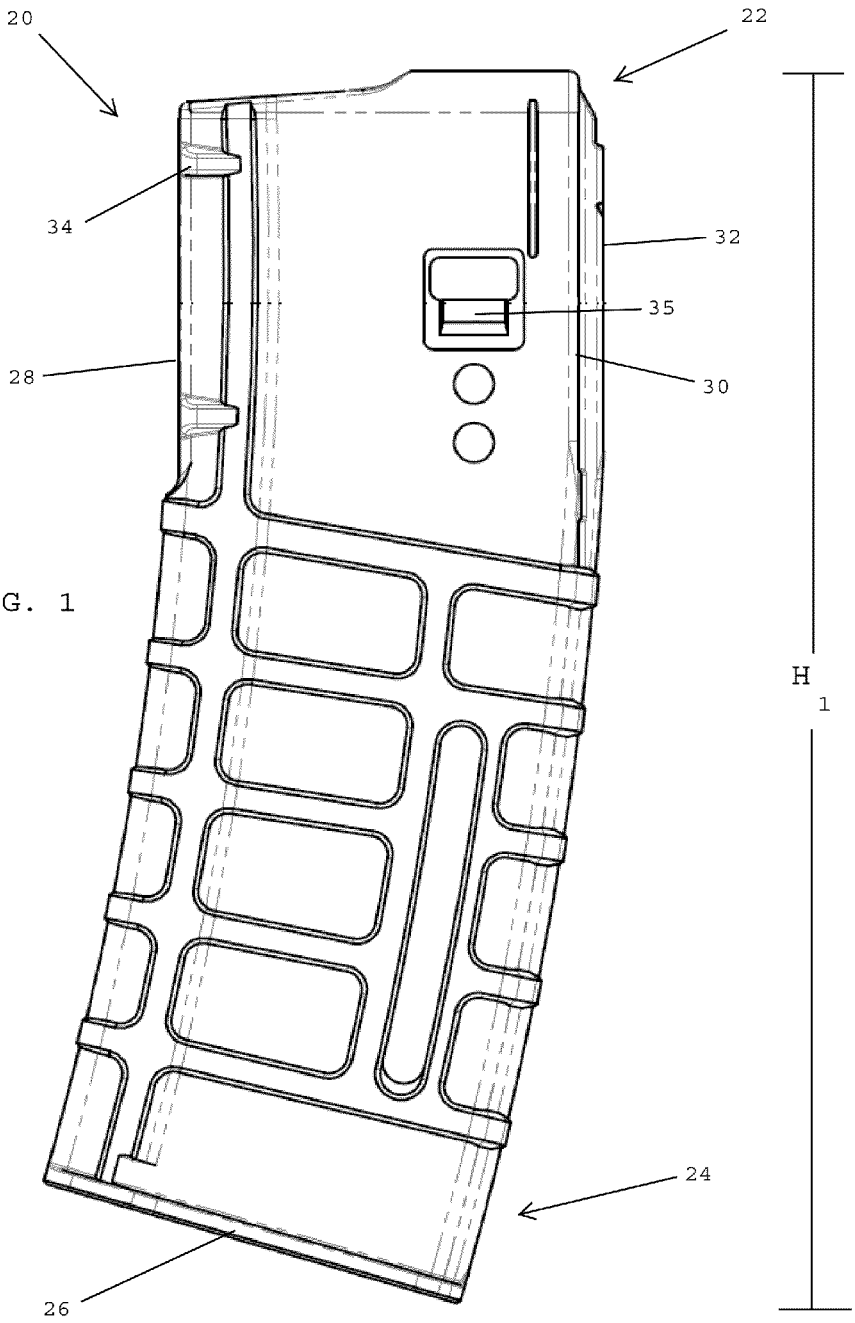
FIG. 1 shows a side elevation view of a standard M16 magazine used for live 5.56×45 mm NATO cartridges.

FIG. 1 shows a standard M16 magazine designated by reference number 20 that is adapted to receive both live rounds, such as 5.56×45 NATO cartridges, and training rounds such as blanks and non-lethal training rounds. The standard M16 magazine 20 has an upper end 22 with a magazine opening adapted to receive live rounds, blanks, and/or training rounds, and a lower end 24 including a base plate 26. The standard M16 magazine 20 has a front wall 28 that extends from the upper end 22 to the lower end 24, and a rear wall 30 that also extends between the upper and lower ends 22, 24. The standard M16 magazine has a height $H_1$ that extends between the upper and lower ends 22, 24.

The rear wall 30 of the standard M16 magazine 20 preferably includes an alignment rib 32 that is adapted for insertion into an alignment groove formed at the rear end of a M16 style magazine well, as will be described in more detail herein. The standard M16 magazine 20 has one or more alignment flanges 34 for engaging the interior walls of the magazine well for aligning and stabilizing the magazine 20 within the magazine well. The standard M16 magazine 20 also has a magazine locking slot 35 that receives a catch on a lower receiver for locking the magazine to the magazine well.

Figure 2:
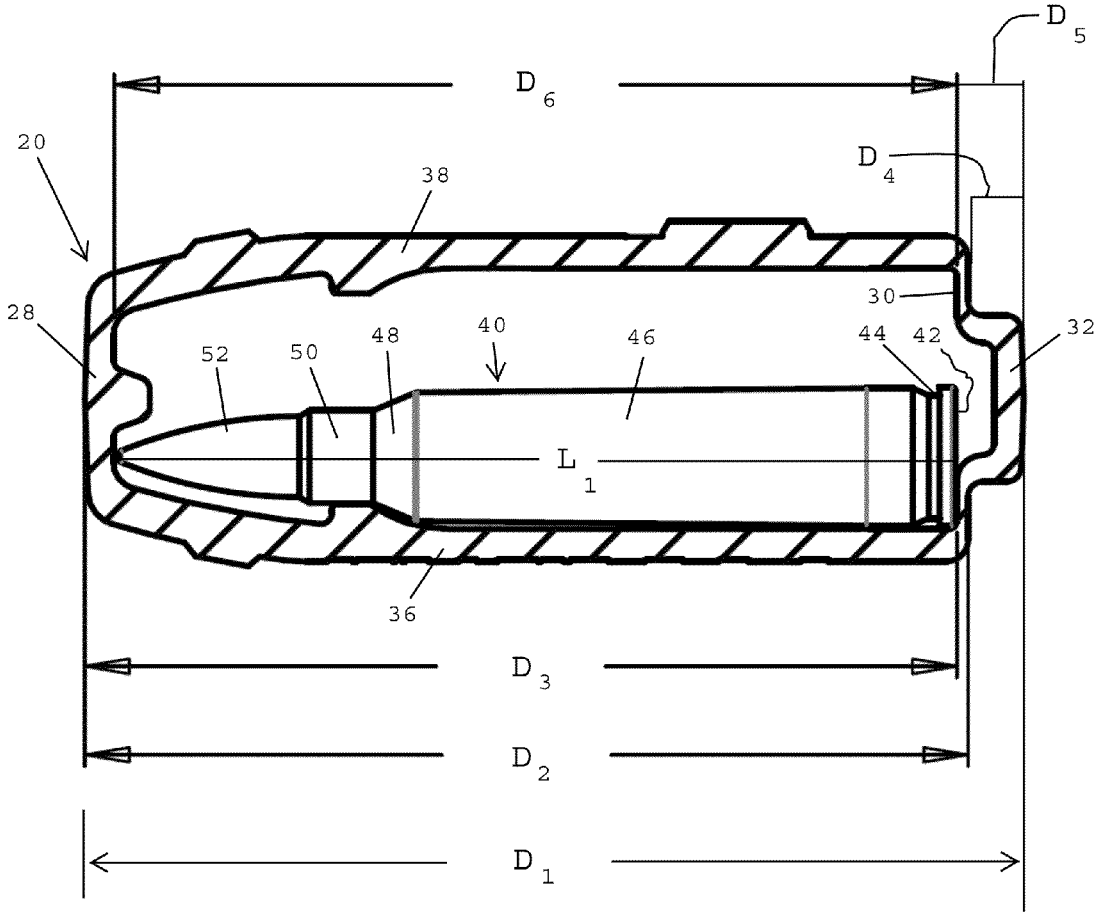
FIG. 2 shows a cross-sectional view of the standard M16 magazine of FIG. 1 having a live 5.56×45 mm NATO cartridge loaded into a magazine opening at an upper end of the magazine.

FIG. 2 shows a top cross-sectional view of the standard M16 magazine 20 shown in FIG. 1. The standard M16 magazine 20 includes the front wall 28 and the rear wall 30 having the alignment rib 32 projecting rearwardly therefrom. The standard M16 magazine 20 also includes opposing sidewalls 36, 38 that extend between the front wall 28 and the rear wall 30. The distance between the front wall 28 and the alignment rib 32 defines the length of the magazine, and the opposing sidewalls 36, 38 define the width of the magazine. The standard M16 magazine preferably has height, length and width dimensions that are adapted to conform to the dimensions of a standard M16 style magazine well as set forth by NATO Standardization Agreement 4179 and United States Government Issue (U.S.G.I.) standards.

In one embodiment, the distance $D_1$ between the outer surface of the front wall 28 and the rear surface of the alignment rib 32, is between about 2-3 inches, and more preferably about 2.535 inches. The distance $D_2$ between the outer surface of the front wall 28 and the outer surface of the rear wall 30 is about 2.385 inches. The distance $D_3$ between the outer surface of the front wall 28 and the inner surface of the rear wall 30 is about 2.354 inches. The distance $D_4$ between the outer surface of the rear wall 30 and the rear surface of the alignment rib 32 is about 0.150 inches. The distance $D_5$ between the inner surface of the rear wall 30 and the rear surface of the alignment rib 32 is about 0.188 inches. The distance $D_6$ between the inner surface of the front wall 28 and the inner surface of the rear wall 30 is about 2.275 inches. The length $L_1$ of the 5.56×45 NATO cartridge is about 2.260 inches, which is less than the distance $D_6$ so that the live round 40 may be loaded into the magazine opening of the standard magazine 20.

The distance $D_6$ between the inner surface of the front wall 28 and the inner surface of the real wall 30 is sufficient for seating the live round 40 having a base 42 seated against the inner surface of the rear wall 30, an extractor recess 44, a body 46, a shoulder 48, a neck 50, and a projectile 52. The distance $D_6$ is preferably longer than the length $L_1$ of the live round 40 so that the live round fits within the space between the inner surface of the front wall 28 and the inner surface of the rear wall 30.

Figure 3:
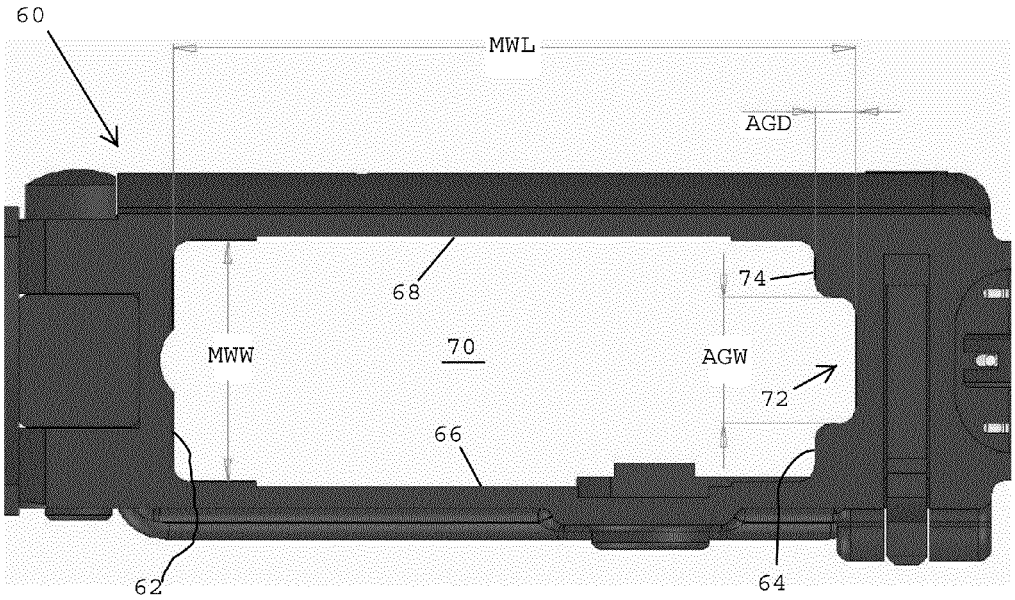
FIG. 3 shows a bottom view of a standard M16 style magazine well adapted to receive the standard magazine of FIG. 1.

The standard M16 magazine 20 shown in FIG. 2 is adapted for being inserted into a M16 style magazine well 60 provided at a lower receiver of a firearm. The M16 style magazine well complies with STANG 4179. Referring to FIG. 3, the magazine well 60 facilitates securing the standard M16 magazine to the lower receiver so that rounds may be advanced into a firing chamber end of a firearm. The magazine well 60 includes a front wall 62 that defines a forward end of the magazine well and a rear wall 64 that defines a rear end of the magazine well. The magazine well 60 also desirably includes opposing sidewalls 66, 68 that extend between the front wall 62 and the rear wall 64. The inner surfaces of the front wall, rear wall, and side wall 66, 68 preferably define a central opening 70 adapted to receive the standard M16 magazine 20, which is shown in FIG. 2. The rear wall 64 of the magazine well 60 preferably has an alignment groove 72 formed therein that is adapted to receive the alignment rib 32 projecting from the rear wall 30 of the standard M16 magazine 20 (FIG. 2). The rear wall 64 has an inner surface 74 that extends laterally from opposite sides of the alignment groove 72. The inner surface 74 is adapted to engage the outer surface of the rear wall 30 of the standard magazine 20.

Figure 4:
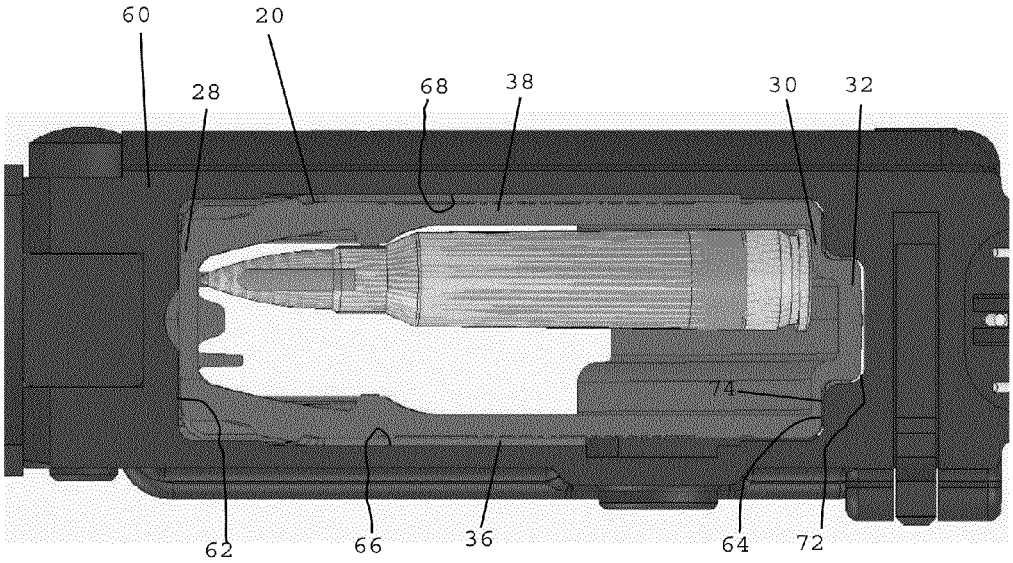
FIG. 4 shows the standard magazine of FIGS. 1 and 2 inserted into the standard M16 style magazine well of FIG. 3.

FIG. 4 shows the standard M16 magazine 20 of FIG. 2 inserted into the standard M16 magazine well 60 of FIG. 3. The front wall 28 of the magazine preferably opposes the front wall 62 of the magazine well. The rear wall 30 of the magazine 20 preferably opposes the inner surface 74 of the rear wall 64 of the magazine well. The alignment rib 32 projecting from the rear wall 30 of the magazine 20 preferably is disposed within the alignment groove 72 formed in the rear wall 64 of the magazine well 60. The opposing sidewalls 36, 38 of the magazine 20 preferably oppose the respective side walls 66, 68 of the magazine well 60.

Referring to FIGS. 3 and 4, the M16 magazine well 60 has a length MWL of about 2.545 inches and a width MWW of about 0.900 inches. The alignment groove 72 of the magazine well 60 has a width AGW of about 0.470 inches and a depth AGD of about 0.152 inches. The dimensions and configuration of the outer surface of the standard magazine desirably match the inner dimensions and configuration of the magazine well 60 so that when the standard magazine is fully inserted into the magazine well, the standard magazine is properly seated, secured and stabilized within the magazine well 60.

Figure 5:
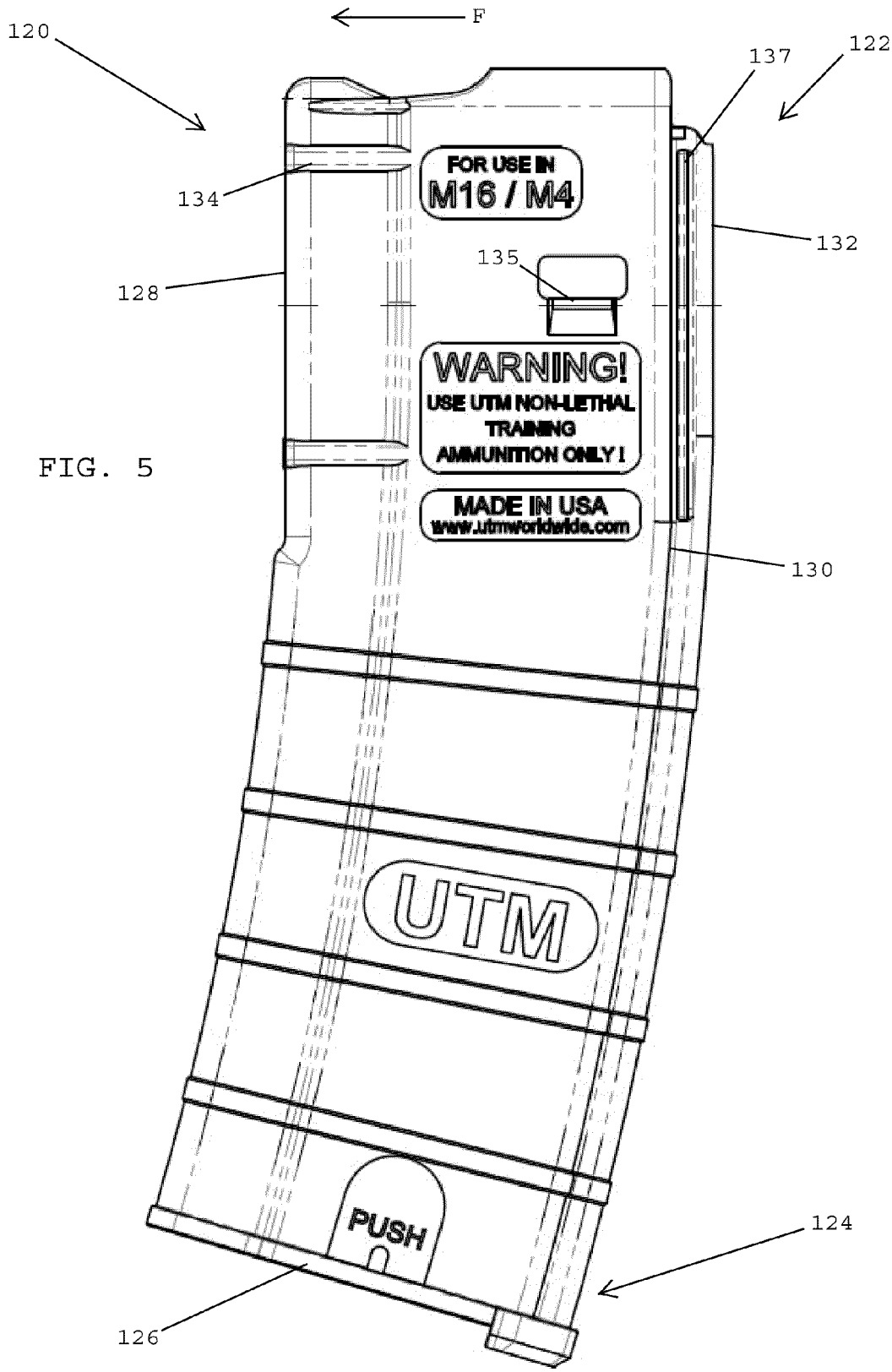
FIG. 5 shows a side elevation view of a safety magazine insertable into a standard M16 style magazine well and having a structure adapted to receive only non-lethal training rounds, in accordance with one embodiment of the present invention.

Referring to FIG. 5, in one embodiment, a safety magazine 120 is insertable into the standard M16 style magazine well 60 shown and described above in FIG. 3. The safety magazine 120 preferably includes an upper end 122 and a lower end 124 having a base plate 126. The safety magazine 120 preferably has a front wall 128 that extends between the upper and lower ends 122, 124, and a rear wall 130 that also extends between the upper and lower ends 122, 124 of the safety magazine 120. The safety magazine 120 also preferably includes an alignment rib 132 that projects from the rear wall 130. The alignment rib 132 is preferably adapted for sliding into the alignment groove 72 (FIG. 3) provided at the rear end of a standard M16 magazine well for securing and stabilizing the safety magazine 120 within the magazine well. The safety magazine 120 also preferably includes one or more alignment flanges 134 projecting from an outer surface of the magazine for aligning and stabilizing the magazine within the M16 style magazine well. The safety magazine 120 preferably includes a locking slot 135 formed therein for selectively locking the safety magazine within the magazine well.

In one embodiment, the safety magazine 120 also preferably includes a spacer wall 137 that projects laterally from opposite sides of the alignment rib 132. The spacer wall 137 preferably spaces the outer surface of the rear wall 130 away from the inner surface 74 of the rear wall 64 of the magazine port 60, which, in turn, shifts the rear wall 130 of the safety magazine 120 forward within the M16 style magazine well 60 (FIG. 3).

Figure 6:
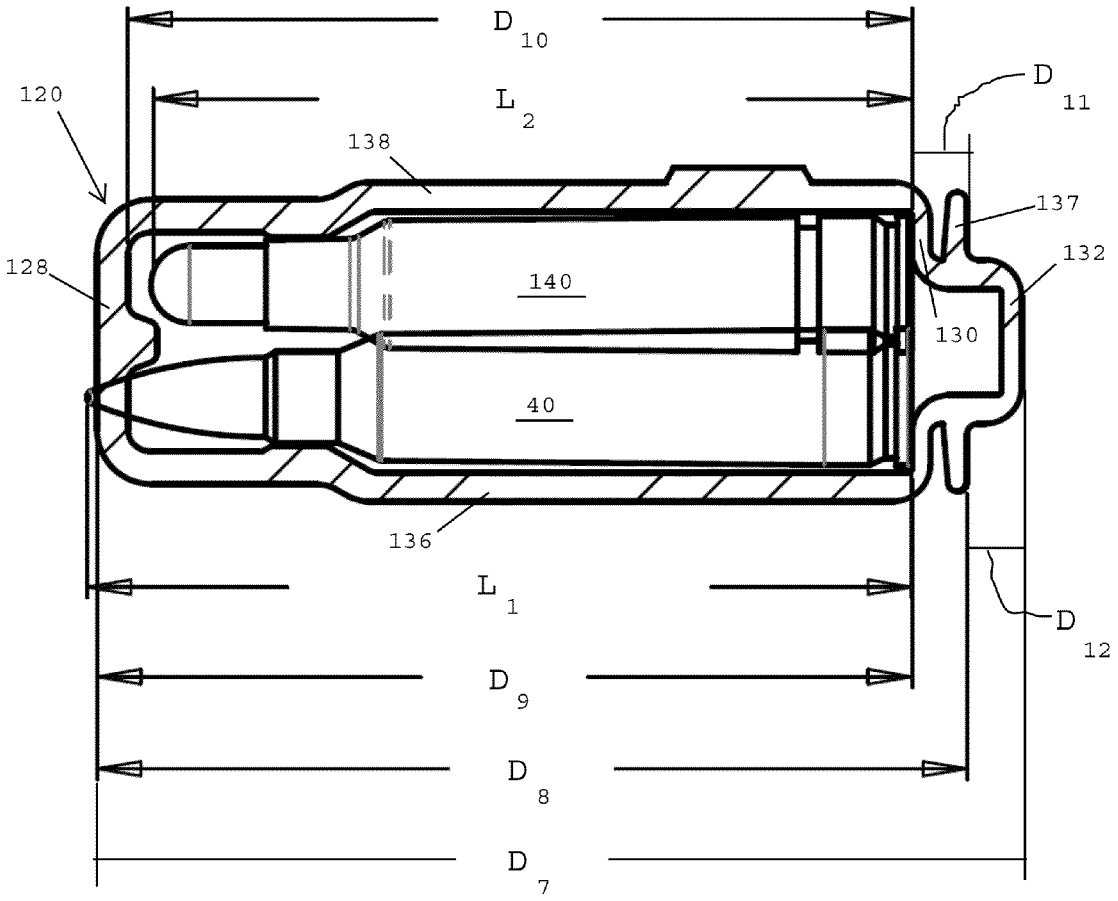
FIG. 6 shows a cross-sectional view of the safety magazine of FIG. 5 having a non-lethal training round and a 5.56×45 mm NATO cartridge loaded therein.

Referring to FIG. 6, in one embodiment, the safety magazine 120 preferably includes the front wall 128 and the rear wall 130 having the alignment rib 132 projecting rearwardly from the rear wall 130. The safety magazine 120 preferably includes the spacer wall 137 projecting laterally from both sides of the alignment rib 132. The safety magazine 120 preferably includes opposing side walls 136, 138 that extend between the front wall 128 and the rear wall 130. The length of the safety magazine is defined by the distance between the outer surface of the front wall 128 and the rear face of the alignment rib 132.

In one embodiment, the distance $D_7$ between the outer surface of the front wall 128 and the rear face of the alignment rib 132 is less than about 2.545 inches, and more preferably about 2.543 inches. In one embodiment, the distance $D_7$ is the same length as the distance $D_1$ shown for the standard M16 magazine of FIG. 2. As such, the safety magazine is adapted for insertion into a standard M16 style magazine well.

In one embodiment, the distance $D_8$ between the outer surface of the front wall 128 and the proximal surface of the spacer wall 137 is about 2.385 inches. In one embodiment, the distance $D_8$ is the same length as the distance $D_2$ on the standard M16 magazine shown in FIG. 2.

The distance $D_9$ between the outer surface of the front wall 128 and the inner surface of the rear wall 130 is about 2.233 inches. The distance $D_{10}$ between the inner surface of the front wall 128 and the inner surface of the rear wall is about 2.148 inches. In one embodiment, the distances $D_9$ and $D_{10}$ are less than the comparable distances $D_3$ and $D_6$ on the standard M16 magazine of FIG. 2. The distance $D_{11}$ between the inner surface of the rear wall 130 and the rear surface of the spacer wall 137 is about 0.152 inches. The distance $D_{12}$ between the rear surface of the spacer wall 137 and the rear surface of the alignment rib 132 is about 0.150 inches.

As noted above, the length $D_{10}$ of the magazine opening at the upper end of the safety magazine 120 is adapted for receiving a non-lethal, training round 140 having a length $L_2$ that is less than the length of a live 5.55 mm round, preferably less than 2.260 inches, and more preferably about 2.079 inches. In one embodiment, the safety magazine 120 is adapted to receive non-lethal training rounds sold by Ultimate Training Munitions (UTM) of Phillipsburg, N.J. having a website address of utmworldwide.com. The live round 40

(FIG. 2) has a length $L_1$ of about 2.260, inches which is too long for the opening at the upper end of the safety magazine 120. As a result, if a live round 40 is accidently inserted into the magazine opening of the safety magazine, the tip of the projectile 52 of the live round 40 will overhang the front wall 128 of the safety magazine 120 and project proximally beyond the outer surface of the front wall 128.

Figure 7A:
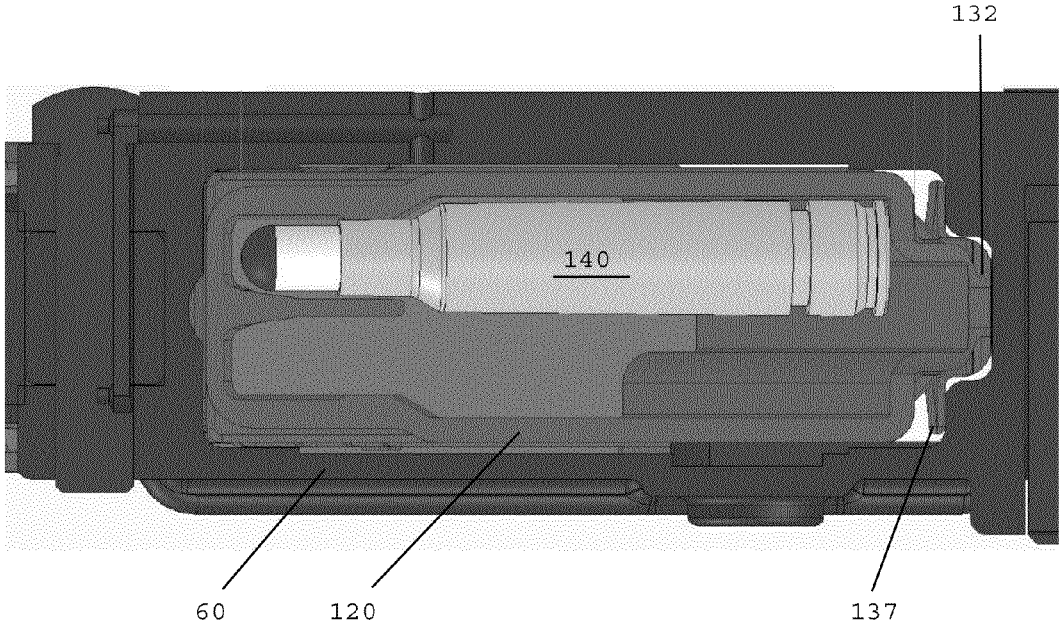
FIG. 7A shows the safety magazine of FIG. 6 inserted into the standard M16 style magazine well, in accordance with one embodiment of the present invention.

Referring to FIG. 7A, in one embodiment, the safety magazine 120 is inserted into the magazine well 60 of the lower receiver. With the safety magazine 120 inserted in the magazine well 60, the front wall 128 of the safety magazine preferably opposes the front wall 62 of the magazine well and the spacer wall 137 of the safety magazine 120 preferably opposes the inner surface 74 of the rear wall 64 of the magazine well 60. The alignment rib 132 projecting rearwardly from the rear wall 130 preferably seats within the alignment groove 72 formed in the rear wall 64 of the magazine well 60. The side walls 136, 138 of the safety magazine 120 preferably oppose the respective side walls 66, 68 of the magazine well 60.

Figure 7B:
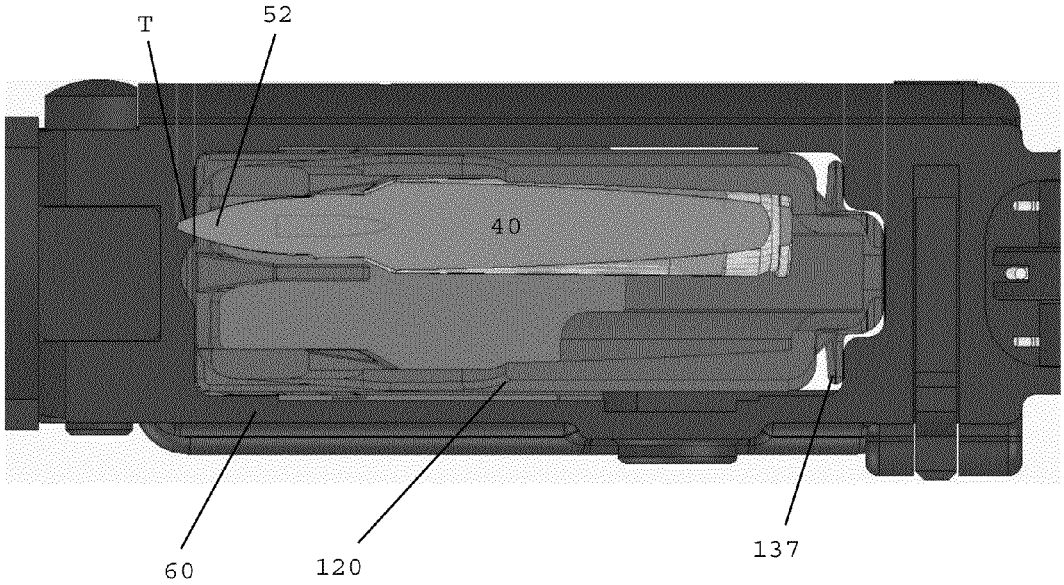
FIG. 7B shows the safety magazine of FIG. 6 with a live round protruding beyond the front wall of the safety magazine that prevents the safety magazine from being fully inserted into the magazine well.

FIG. 7B shows the safety magazine 120 with a longer, live round 40. The tip T of the projectile 52 on the live round 40 extends beyond the front wall 128 of the safety magazine 120. As a result, the tip T will strike a ledge located between an upper end of the magazine well 120 and a chamber so that the safety magazine cannot be fully inserted into the magazine well.

Figure 8:
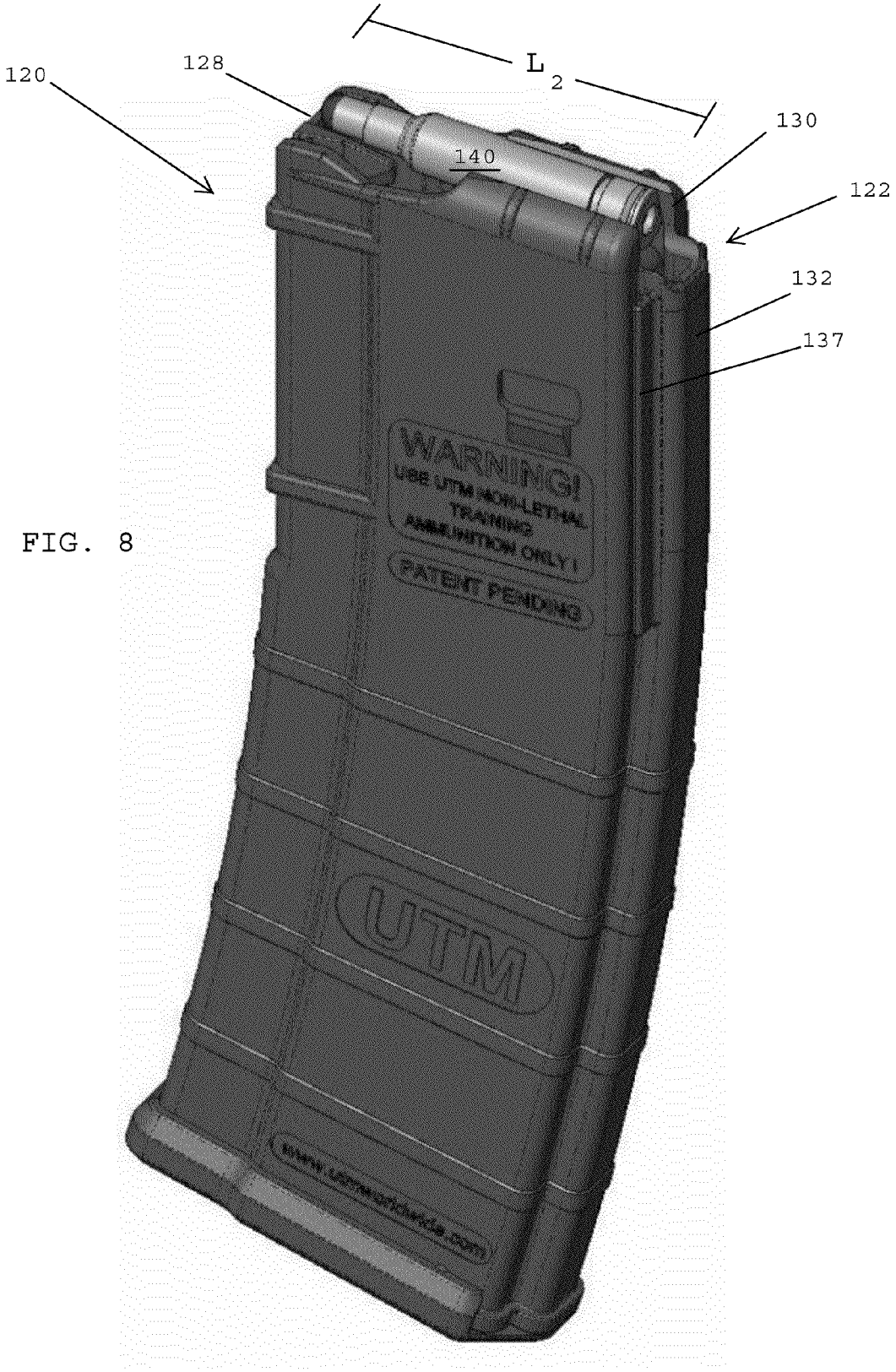
FIG. 8 shows a top perspective view of the safety magazine of FIG. 5 having a non-lethal training round loaded therein, in accordance with one embodiment of the present invention.

FIG. 8 shows a non-lethal training round 140 loaded into the magazine opening at the upper end 122 of the safety magazine 120. The non-lethal training round 140 has a length $L_2$ of about 2.079 inches that is less than the distance D10 (FIG. 6) between the front and rear walls so that the training round 140 fits between the inner surfaces of the front wall 128 and the rear wall 130 of the safety magazine 120. An elongated alignment rib 132 projects rearwardly from the rear wall 130 of the safety magazine 120. A spacer wall 137 projects laterally from the sides of the elongated alignment rib 132. In one embodiment, the spacer wall 137 is preferably positioned between the rear wall 130 of the safety magazine 120 and a rear face of the elongated alignment rib 132.

Figure 9:
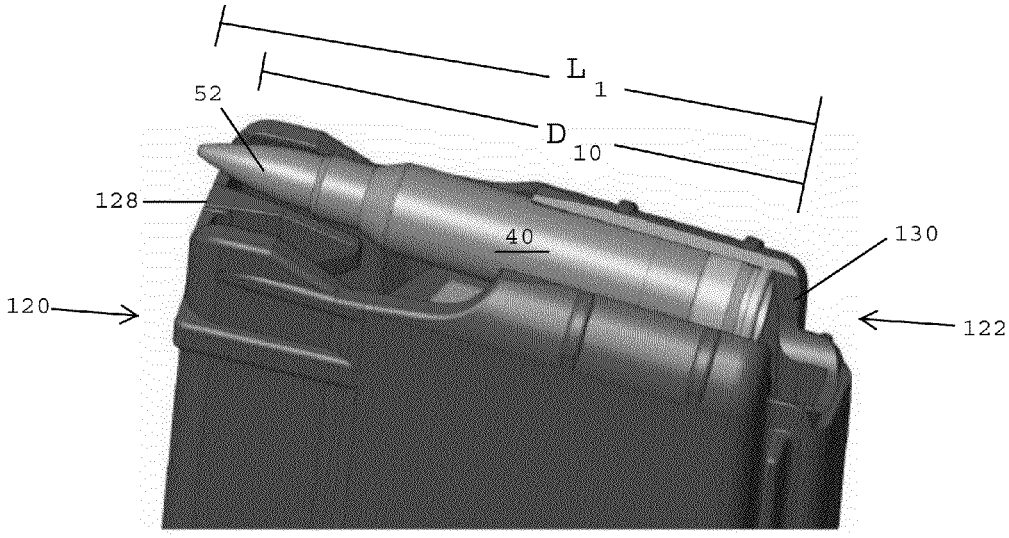
FIG. 9 shows a top perspective view of the safety magazine of FIG. 5 having a live 5.56×45 mm NATO cartridge improperly loaded therein.

FIG. 9 shows a live round 40 loaded into the magazine opening at the upper end 122 of the safety magazine 120. The live round 40 has a length $L_1$ that exceeds the distance $D_{10}$ between the inner surface of the front wall 128 and the inner surface of the rear wall 130. Because the live round 40 is too long for the magazine opening of the safety magazine 120, the tip T of the projectile 52 extends beyond the outer surface of the front wall 128.

Figure 10:
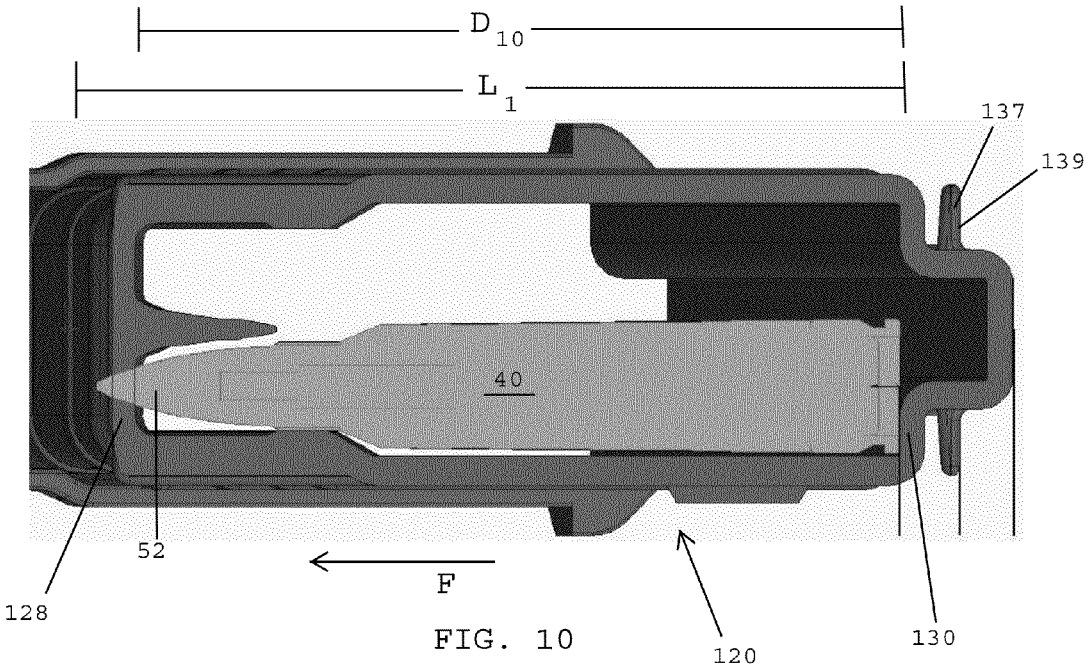
FIG. 10 shows a top plan view of the safety magazine of FIG. 8 having the 5.56×45 mm NATO cartridge improperly loaded therein.

FIG. 10 shows another view of the live round 40 inserted into the magazine opening at the upper end of the safety magazine 120. The live round 40 has a length $L_1$ of about 2.260 inches that exceeds the distance $D_{10}$ between the inner surface of the front wall 128 and the inner surface of the rear wall 130. The tip T of the projectile 52 extends beyond the front wall 128.

The spacer wall 137 has a proximal surface 139 that is adapted to abut against the rear end wall 64 (FIG. 3) of the M16 style magazine well. Thus, the spacer wall 137 spaces the rear wall 130 away from the rear end wall of the magazine well, which shifts the rear wall 130 of the safety magazine 120 toward the forward end of the magazine well in the direction F.

Figure 11A:
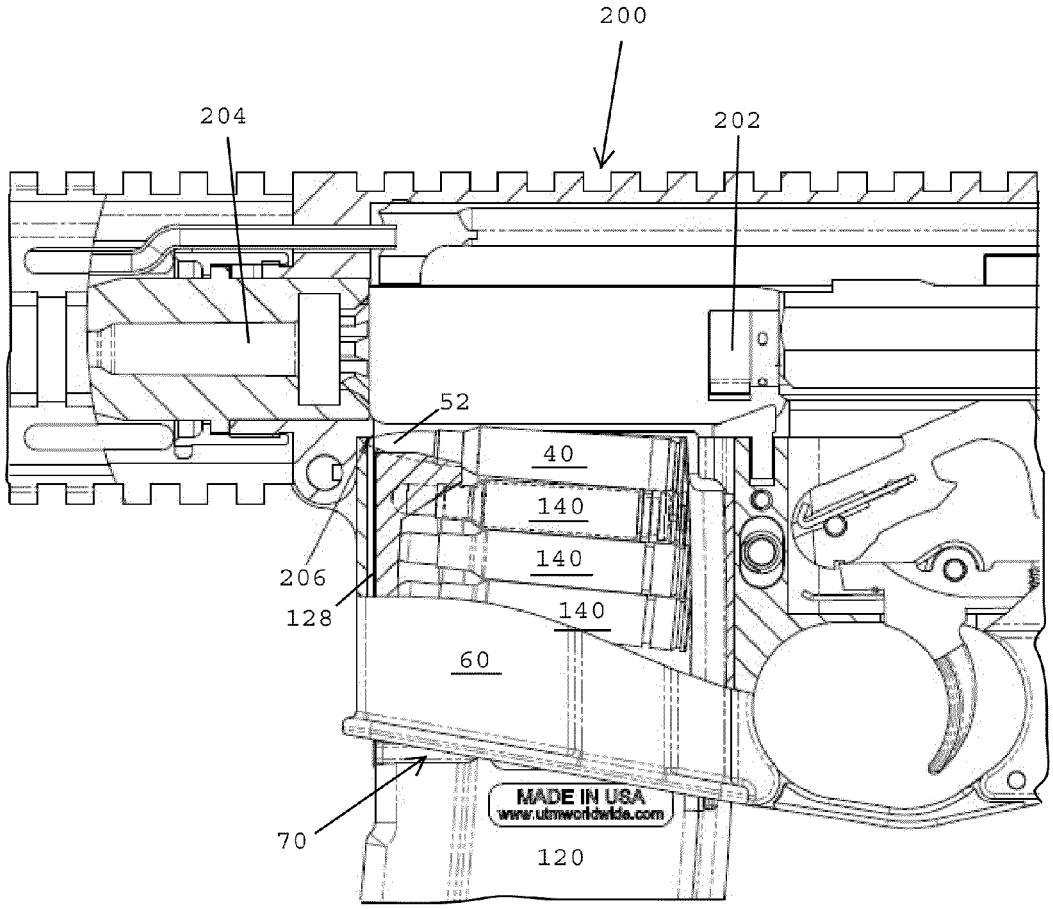
FIG. 11A shows the safety magazine of FIGS. 9 and 10 partially inserted into a standard M16 magazine well of a lower receiver.

Referring to FIG. 11A, in one embodiment, a lower receiver 200 of a firearm includes a magazine well 60 having an opening 70 adapted to receive the safety magazine 120. The lower receiver 200 includes a sliding bolt 202 adapted to advance the training rounds into a firing chamber 204 that is aligned with the bolt 202. In one embodiment, the sliding bolt 202 is adapted to engage the top round in the magazine for loading the round into the chamber 204.

In FIG. 11A, a live round 40 has been accidently loaded as the top round at the upper end of the safety magazine 120. The projectile 52 of the live round 40 has a tip that overhangs the front wall 128 of the safety magazine. When an attempt is made to insert the safety magazine into the magazine well, the tip of the projectile 52 contacts a ledge 206 located between an upper end of the magazine well 60 and the chamber 204. As a result, the live round 40 cannot advance above the ledge 206 at the upper end of the magazine well and, therefore, the live round 40 cannot be loaded into the firing chamber 204. Moreover, the engagement of the tip of the projectile 52 with the ledge 206 prevents the safety magazine 120 from being fully inserted into the magazine well 60 of the lower receiver 200.

Figure 11B:
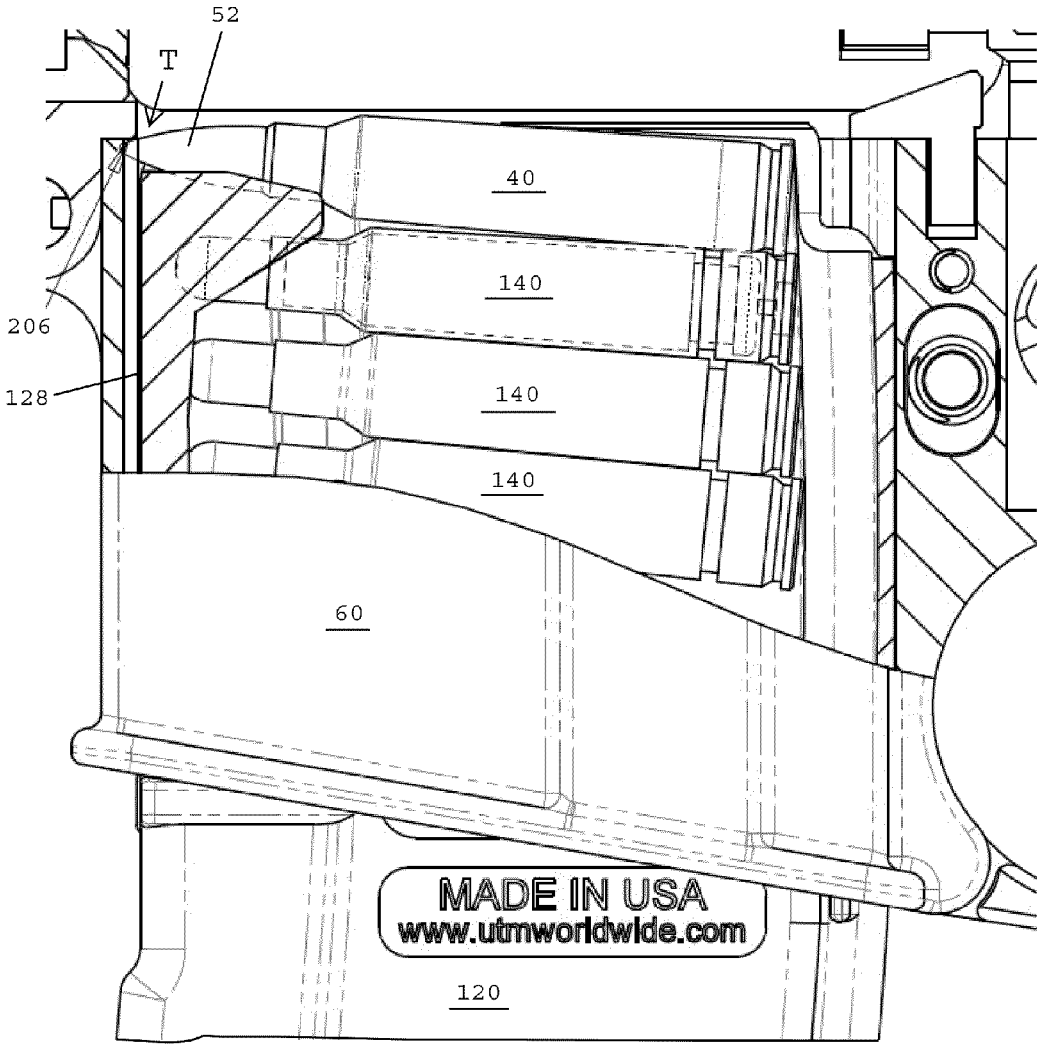
FIG. 11B shows a magnified view of the safety magazine and the standard M16 style magazine well of FIG. 11A.

FIG. 11B shows a magnified view of the tip T of the projectile 52 of the live round 40 overhanging the front wall 128 of the safety magazine. As such, when an attempt is made to insert the safety magazine 120 into the magazine well 60, the tip T strikes the ledge 206, which prevents the live round 40 from advancing above the ledge 206, which, in turn, prevents the safety magazine 120 from being fully and properly inserted into the magazine well 60. The failure of the safety magazine to be fully inserted into the magazine well 60 prevents the bolt 202 (FIG. 11A) from being able to direct the live round into the chamber 204.

While the foregoing is directed to embodiments of the present invention, other and further embodiments of the invention may be devised without departing from the basic scope thereof, which is only limited by the scope of the claims that follow. For example, the present invention contemplates that any of the features shown in any of the embodiments described herein, or incorporated by reference herein, may be incorporated with any of the features shown in any of the other embodiments described herein, or incorporated by reference herein, and still fall within the scope of the present invention.

What is claimed is:

1. A safety magazine insertable into a standard M16 style magazine well, said safety magazine being adapted for enabling non-lethal training cartridges to be fired while preventing the loading and firing of standard 5.56×45 mm NATO cartridges, said safety magazine comprising:

a front wall;

a rear wall opposing said front wall, wherein the distance between said front and rear walls is less than the length of a standard 5.56×45 mm NATO cartridge;

first and second sidewalls extending between said front and rear walls;

an alignment rib projecting from said rear wall of said magazine, said alignment rib having a rear face that is parallel to said rear wall;

a spacer projecting laterally from the sides of said alignment rib and being located between said rear wall of said safety magazine and said rear face of said alignment rib, said spacer having a proximal surface that is parallel to both said rear wall of said safety magazine and said rear face of said alignment rib, wherein said alignment rib is adapted for insertion into an alignment groove formed in a rear end wall of a standard M16 style magazine well, and wherein said spacer is adapted to engage said rear end wall of said standard M16 style magazine well for spacing said rear wall of said safety magazine away from said rear end wall of said standard M16 style magazine well.

2. The safety magazine as claimed in claim 1, wherein the distance between said rear face of said alignment rib of said safety magazine and an inner surface of said rear wall of said safety magazine is at least 50% greater than a comparable distance measured between a rear face of an alignment rib and an inner surface of a rear wall on a standard M16 magazine that complies with NATO Standardization Agreement 4179.

3. The safety magazine as claimed in claim 2, wherein the distance between said rear face of said alignment rib and said inner surface of said rear wall of said safety magazine is at least 60% greater than the comparable distance on said standard M16 magazine.

4. The safety magazine as claimed in claim 3, wherein the distance between said rear face of said alignment rib and said inner surface of said rear wall of said safety magazine is about 70% greater than the comparable distance on said standard M16 magazine.

5. The safety magazine as claimed in claim 2, wherein the distance between said rear face of said alignment rib of said safety magazine and an inner surface of said rear wall of said safety magazine is about 0.321 inches and the comparable distance on said standard M16 magazine is about 0.188 inches.

6. The safety magazine as claimed in claim 1, wherein the distance between said proximal face of said spacer and said inner surface of said rear wall of said safety magazine is about 0.171 inches.

7. The safety magazine as claimed in claim 1, wherein the distance between opposing inner surfaces of said front and rear walls is about 2.148 inches and the length of said non-lethal training round is about 2.079 inches.

8. The safety magazine as claimed in claim 7, wherein the length of said standard 5.56×45 mm NATO cartridge is about 2.260 inches.

9. The safety magazine as claimed in claim 1, wherein the distance between said rear face of said alignment rib and an inner surface of said rear wall is about 0.321 inches and the distance between said rear face of said alignment rib and said proximal face of said spacer is about 0.150 inches.

10. The safety magazine as claimed in claim 1, wherein said safety magazine is adapted for being inserted into a standard M16 style magazine well that complies with dimension specifications set forth under NATO Standardization Agreement 4179.

11. The safety magazine as claimed in claim 10, wherein said standard M16 style magazine well has a length of about 2.545 inches and the length of said safety magazine measured between said outer surface of said front wall and said rear face of said alignment rib is less than 2.545 inches.

12. A safety magazine for a standard M16 style magazine well that enables non-lethal training rounds to be fired while preventing the loading and firing of 5.56×45 mm NATO live rounds, said safety magazine comprising:

a front wall and a rear wall spaced from said front wall, wherein the distance between opposing inner surfaces of said front and rear walls is less than the length of a standard 5.56×45 mm NATO live round;

first and second sidewalls extending between said front and rear walls;

an elongated alignment rib projecting rearwardly from said rear wall of said safety magazine, said elongated alignment rib having a rear face that is parallel to said inner surface of said rear wall of said safety magazine, wherein the distance between said rear face of said alignment rib and said inner surface of said rear wall of said safety magazine is about 0.321 inches; and a spacer projecting laterally from opposite sides of said alignment rib and being located between said rear wall of said safety magazine and said rear face of said elongated alignment rib, said spacer having a proximal surface that is parallel to said inner surface of said rear wall of said safety magazine and said rear face of said alignment rib, wherein the distance between said proximal surface of said spacer and said rear face of said elongated alignment rib is about 0.150 inches.

13. The safety magazine as claimed in claim 12, wherein said spacer comprises a spacer wall adapted for spacing said rear wall of said safety magazine away from a rear end wall of a standard M16 style magazine well when said safety magazine is inserted into said standard M16 style magazine well.

14. The safety magazine as claimed in claim 12, wherein the distance between said inner surface of said front wall and said inner surface of said rear wall of said safety magazine is about 2.148 inches and a non-lethal training round adapted for being loaded into said safety magazine has a length of less than 2.148 inches.

15. The safety magazine as claimed in claim 12, wherein said safety magazine is adapted for being inserted into a standard M16 style magazine well that complies with the magazine well dimension requirements set forth under NATO Standardization Agreement 4179.

16. The safety magazine as claimed in claim 12, wherein said standard M16 style magazine well has a length of about 2.545 inches, and the length of said safety magazine measured from said outer surface of said front wall to said rear face of said elongated alignment rib is less than 2.545 inches.

17. A safety magazine adapted for insertion into a standard M16 style magazine well provided on a firearm having a lower receiver that complies with NATO Standardization Agreement 4179, said safety magazine enabling non-lethal training rounds to be fired with said firearm while preventing the loading and firing of 5.56×45 mm NATO cartridges using said firearm, said safety magazine comprising:

a front wall and a rear wall, wherein the distance between opposing inner surfaces of said front and rear walls is less than the length of a 5.56×45 mm NATO cartridge;

first and second sidewalls extending between said front and rear walls;

an elongated alignment rib projecting rearwardly from said rear wall, said elongated alignment rib having a rear face that is parallel to said inner surface of said rear wall of said safety magazine, wherein the distance between said rear face of said elongated alignment rib and said inner surface of said rear wall of said safety magazine is about 0.321 inches; and a spacer projecting laterally from the sides of said alignment rib and being located between said rear face of said elongated alignment rib and said inner surface of said rear wall of said safety magazine, said spacer having a proximal surface that is parallel to said inner surface of said rear wall and said rear face of said elongated alignment rib, wherein the distance between said proximal surface of said spacer and said rear face of said elongated alignment rib is about 0.150 inches.

18. The safety magazine as claimed in claim 17, wherein said standard M16 style magazine well has a length of about 2.545 inches, and the length of said safety magazine measured between said outer surface of said front wall and said rear face of said elongated alignment rib is less than 2.545 inches.

19. The safety magazine as claimed in claim 17, wherein the length of one of said 5.56×45 mm NATO cartridges is greater that the distance between said inner surface of said rear wall of said safety magazine and said outer surface of said front wall of said safety magazine.

20. The safety magazine as claimed in claim 19, wherein the length of one of said 5.56×45 mm NATO cartridges is about 2.260 inches, and the distance between said inner surface of said rear wall and said outer surface of said front wall is about 2.233 inches, and wherein a leading tip of the one of said 5.56×45 mm NATO cartridges extends beyond said outer surface of said front wall of said safety magazine when the one of said 5.56×45 mm NATO cartridges is loaded into said safety magazine.

* * * * *